United States Patent [19]

Whatton et al.

[11] 4,433,813

[45] Feb. 28, 1984

[54] METHOD FOR FORMING WOOD FIBRES

[76] Inventors: Rodney Whatton, Wych Elm, Ampney Crucis, Cirencester, Gloucestershire; Timothy W. Gilder, Lypiatt House, Chelworth Rd., Cricklade, Swindon, both of England

[21] Appl. No.: 175,679

[22] Filed: Aug. 5, 1980

[30] Foreign Application Priority Data

Aug. 10, 1979 [GB] United Kingdom ..... 7927881

[51] Int. Cl.[3] ..... B27I 11/08

[52] U.S. Cl. ..... 241/21; 241/28; 241/73; 241/101.7; 404/71

[58] Field of Search ..... 241/21, 28, 73, 101.7, 241/189 R, 194; 404/71, 72, 75, 76, 82; 272/5

[56] References Cited

U.S. PATENT DOCUMENTS

| | | | |
|---|---|---|---|
| 2,374,046 | 4/1945 | Stacom | 241/28 X |
| 2,446,304 | 8/1948 | Roman | 241/28 X |
| 2,532,660 | 12/1950 | Care | 241/28 X |
| 2,869,793 | 1/1959 | Montgomery | 241/73 X |
| 2,986,347 | 5/1961 | Stevenson | 241/73 X |
| 3,527,417 | 9/1970 | Tompsett | 241/101.7 |
| 3,617,006 | 11/1971 | Jones | 241/28 X |
| 3,627,212 | 12/1971 | Stanton | 241/194 X |
| 3,989,198 | 11/1976 | Blasko | 241/189 R |
| 4,030,865 | 6/1977 | Kobayaski | 241/73 X |

*Primary Examiner*—James M. Meister

*Attorney, Agent, or Firm*—Young & Thompson

[57] ABSTRACT

A method of forming wood fibres for use in the production of a riding surface comprises feeding wood chips having a length, in the grain direction, of from 18 mm to 35 mm, to a milling machine adjusted to break the wood chips into wood fibres, the lengths of the fibres produced by the milling machine being substantially in accordance with the following percentages, by volume, of the total volume:

| Wood fibre length | Percentage of Total Fibre |
|---|---|
| 0 mm–5 mm | 10%–20% |
| 5 mm–15 mm | 40%–55% |
| 15 mm–35 mm | 35%–50% |

It is found that a surface formed from a compacted layer, several inches deep, of fibres produced by the above method has excellent characteristics for horse riding and these characteristics are not unduly affected by variations in weather conditions.

9 Claims, 2 Drawing Figures

METHOD FOR FORMING WOOD FIBRES

BACKGROUND OF THE INVENTION

The invention relates to the production of wood fibres for use in the construction of all-weather horse riding surfaces.

As is well known, the characteristics of conventional horse riding surfaces, such as turf and sand, vary according to the weather conditions. Also such surfaces are liable to serious damage, rendering them temporarily unusable, under extremes of weather conditions such as severe frost. To overcome these disadvantages it has been proposed to construct an all-weather riding surface from a thick layer of wood fragments, since such a surface is less susceptible to variations in weather conditions. Generally such riding surfaces have been formed from mixed wood residues from timber processing plants and have comprised a mixture of wood shavings, chippings, fibres and sawdust in variable proportions. It has been found, however, that an improved and more consistent surface may be provided by forming the surface from a more consistent mixture of wood fibres, and the present invention provides a method and apparatus for forming wood fibres in a mixture having desirable characteristics for use as a riding surface.

SUMMARY OF THE INVENTION

According to the invention a method of forming wood fibres for use in the production of a riding surface comprises feeding wood chips having a length, in the grain direction, of from 18 mm to 35 mm, to a milling machine adjusted to break the wood chips into wood fibres, the lengths of the fibres produced by the milling machine being substantially in accordance with the following percentages, by volume, of the total volume:

| Wood fibre length | Percentage of Total Fibre |
|---|---|
| 0 mm–5 mm | 10%–20% |
| 5 mm–15 mm | 40%–55% |
| 15 mm–35 mm | 35%–50% |

It is found that a surface formed from a compacted layer, several inches deep, of fibres produced by the above method has excellent characteristics for horse riding and these characteristics are not unduly affected by variations in weather conditions.

The wood chips may be produced by the preliminary step of feeding timber into a wood chipping machine adjusted to produce said wood chips having a length, in the grain direction, of from 18 mm to 35 mm.

Preferably the mean length of the wood chips is substantially 25 mm.

In order to produce the proportions of fibre lengths referred to above it may be necessary to adjust the moisture content of the wood chips before subjecting them to the milling process, and the method may therefore comprise the further step of adding liquid to the wood chips, before milling, to adjust the moisture content thereof. Preferably the moisture content is adjusted to be in the region of 45%.

The milling machine may be of a known form comprising a plurality of coaxially rotating elements each having mounted at the periphery thereof a plurality of hammers which, as the discs rotate, cooperate with a closely encircling peripheral surface to break the wood chips into fibres before passing the fibres through a screen. The screen preferably has a 25 mm mesh size.

Preferably at least a major proportion of the timber from which said wood chips are formed is hardwood. Preferably also at least a proportion of the timber from which said wood chips are formed comprises whole natural timber including bark.

To reduce the cost of transport of large quantities of wood fibres produced according to the invention, the milling portion of the method is preferably carried out at the site where the riding surface is to be constructed. A mobile apparatus for use in carrying out the above method may be provided, the apparatus comprising a wheeled support on which are mounted a hopper for receiving wood chips having a length in the grain direction of from 18 mm to 35 mm, a milling machine, a motor driving the milling machine, a conveyor delivering wood chips from the lower end of the hopper to the milling machine, and a conveyor delivering wood fibre from the outlet of the milling machine.

The wheeled support may be self propelled or may comprise a trailer vehicle.

DETAILED DESCRIPTION OF THE PREFERRED EMBODIMENT

Figure 1:
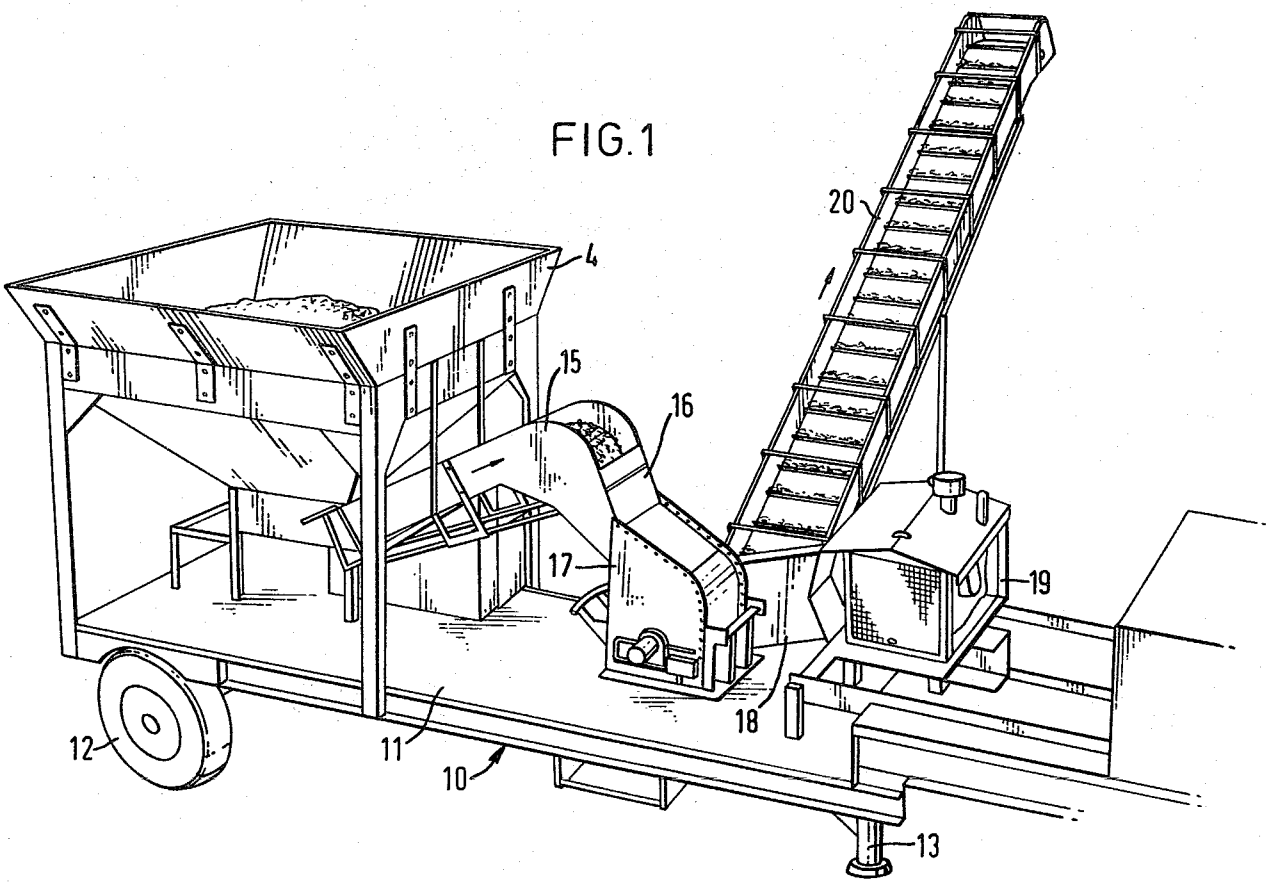
FIG. 1 is a diagrammatic perspective view of mobile apparatus for producing wood fibres in accordance with the invention.

The mobile apparatus shown in FIG. 1 comprises a trailer vehicle 10 for coupling to a tractor vehicle and comprising a horizontal platform 11, rear road wheels 12, and front support legs 13 which are lowered to support the front end of the trailer when it is disconnected from the tractor vehicle.

Mounted at the rear end of the platform 11 is an open-topped hopper 14 for receiving wood chips. An endless belt conveyor 15 extends upwardly from the lower, discharge end of the hopper 14 so as to deliver wood chips from the hopper into the upper feed inlet 16 of a milling machine 17. The milling machine 17 will be described in greater detail with reference to FIG. 2.

The milling machine 17 is driven by means of a transmission, indicated at 18, from a power unit 19 which may comprise a diesel engine mounted on the platform 11.

A further endless belt conveyor 20 extends upwardly away from the outlet from the milling machine 17 so as to deliver wood fibres from the milling machine to a collection vehicle or storage pile adjacent the apparatus.

Figure 2:
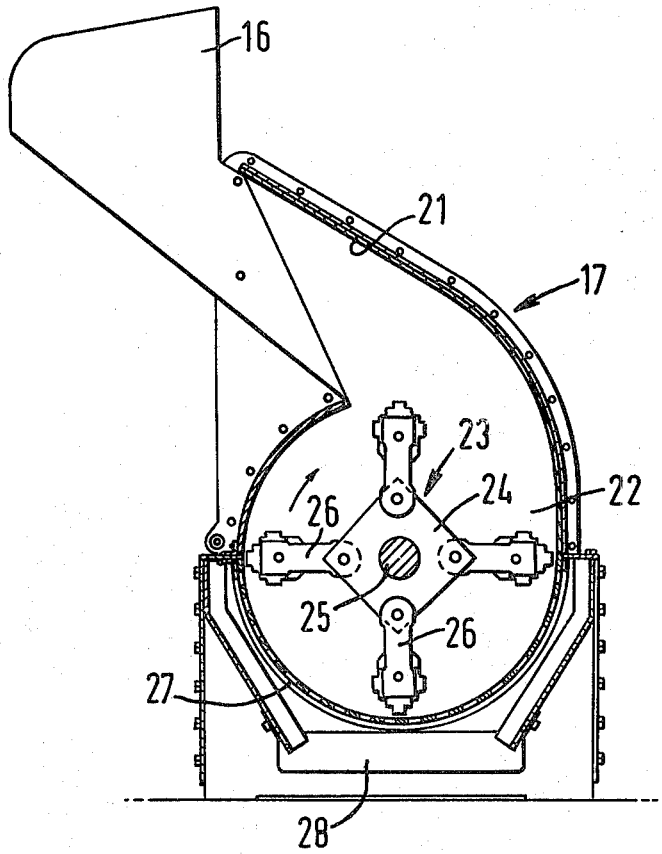
FIG. 2 is a diagrammatic vertical section through one type of milling machine which may be used in the apparatus of FIG. 1.

Referring to FIG. 2, the casing of the milling machine 17 provides a downwardly inclined conduit 21 which leads from the feed inlet 16 into the upper part of a cylindrical milling chamber 22. Rotatable within the chamber 22 are a plurality of coaxial parallel beaters 23 each comprising a central square hub plate 24 secured to a shaft 25 and having mounted at the periphery thereof four equally spaced hammers 26 which extend radially outwards to a point just clear of the encircling peripheral wall of the chamber 22. The hammers 26 cooperate with the encircling wall surface to break into fibres the wood chips which are delivered into the feed inlet 16 from the above-mentioned conveyor 15.

The lower half of the peripheral wall of the chamber 22 is in the form of a screen 27 so that when the fibres have been broken down to a sufficiently small size they pass through the screen 27 into an outlet tray 28 from which they are picked up by the aforementioned conveyor 20.

In use of the above described apparatus, wood chips having a length, in the grain direction, of from 18 mm to 35 mm, and preferably of substantially 25 mm, are delivered to the hopper 14 from where they are delivered by the conveyor 15 to the milling machine 17. Liquid may be added to the wood chips at any stage before they pass into the milling machine 17 to adjust the moisture content thereof until it is preferably in the region of 45%.

The moisture content and make-up of the wood chips, the size of the screen 27, and the characteristics of the milling machine 17 are so selected that the lengths of the fibres produced by the milling machine are substantially in accordance with the following percentages, by volume, of the total volume.

| Wood fibre length | Percentage of Total Fibre |
|---|---|
| 0 mm–5 mm | 10%–20% |
| 5 mm–15 mm | 40%–55% |
| 15 mm–35 mm | 35%–50% |

It is found in practice that a 25 mm mesh size is suitable for the screen 27.

The wood fibres produced by the described method are particularly suitable for use in the construction of horse riding surfaces for training and/or racing. In constructing such a riding surface a layer of wood fibres is deposited on a flat polyester membrane formed with drainage holes, the surface on which the membrane is laid having been well compacted with two to three inches of brick rubble or ballast. Although the membrane may be laid in the bottom of a shallow channel or other shallow excavation, it is preferably laid on the surface of the ground within a surrounding upstanding wall of timber or concrete. It will be appreciated that this greatly reduces the difficulty and cost of laying the surface. After laying the fibres on the membrane and within the surrounding wall to a depth of about nine inches (23 cms), the surface is raked level and watered and compacted with a heavy roller.

During use of the surface the smaller fibres migrate to the bottom of the layer and provide a compact and firm base layer over wich extends a more open top surface which therefore readily drains and which is resistent to frost.

The described apparatus, being mobile, allows the method of producing wood fibres according to the invention to be carried out at the site where the riding surface is to be constructed. In this case the mobile apparatus is taken to the site at which the riding surface is to be laid, and wood chips of the required size are obtained from the nearest local wood chipping plant, using local timber at least a major proportion of which is preferably hard wood, the chips being formed from lengths of whole natural timber including bark. It is found that the use of such timber for the chips improves the characteristics of the final riding surface.

Any suitable method and apparatus may be used for producing wood chips having the required length, in the grain direction, of from 18 mm to 35 mm, and preferably 25 mm. However, one suitable known form of wood chipping machine comprises a rotating disc having chipping blades mounted around the periphery thereof, the timber being fed in the direction of its grain at an angle to the axis of rotation of the disc.

We claim:

1. A method of forming wood fibres for use in the production of a riding surface comprising feeding wood chips having a length, in the grain direction, of from 18 mm to 35 mm, to a milling machine adjusted to break the wood chips into wood fibres, the lengths of the fibres produced by the milling machine being substantially in accordance with the following percentages by volume, of the total volume:

| Wood fibre length | Percentage of Total Fibre |
|---|---|
| 0 mm–5 mm | 10%–20% |
| 5 mm–15 mm | 40%–55% |
| 15 mm–35 mm | 35%–50% |

2. A method of forming wood fibres according to claim 1, comprising the preliminary step of feeding timber into a wood chipping machine adjusted to produce said wood chips having a length, in the grain direction, of from 18 mm to 35 mm.

3. A method according to claim 1, wherein the mean length of the wood chips is substantially 25 mm.

4. A method according to claim 1, comprising the further step of adding liquid to the wood chips, before milling, to adjust the moisture content thereof.

5. A method according to claim 4, wherein the moisture content is adjusted to be in the region of 45% .

6. A method according to claim 1, wherein the milling machine comprises a plurality of coaxially rotating elements each having mounted at the periphery thereof a plurality of hamers which, as the elements rotate, cooperate with a closely encircling peripheral surface to break the wood chips into fibres before passing the fibres through a screen.

7. A method according to claim 6, wherein the screen has a 25 mm mesh size.

8. A method according to claim 1, wherein at least a major proportion of the timber from which said wood chips are formed is hardwood.

9. A method according to claim 1, wherein at least a proportion of the timber from which said wood chips are formed comprises whole natural timber including bark.

* * * * *